US005617794A

United States Patent [19]

Theurer et al.

[11] Patent Number: 5,617,794

[45] Date of Patent: Apr. 8, 1997

[54] TRACK STABILIZATION MACHINE HAVING STABILIZATION UNITS LINKED TO OSCILLATING OUT OF PHASE WITH EACH OTHER

[75] Inventors: Josef Theurer, Vienna; Bernhard Lichtberger, Leonding, both of Austria

[73] Assignee: Franz Plasser Bahnbaumaschinen-Industriegesellschaft m.b.H., Vienna, Austria

[21] Appl. No.: 648,280

[22] Filed: May 15, 1996

[30] Foreign Application Priority Data

Jun. 16, 1995 [AT] Austria ..... 1035/95

[51] Int. Cl.[6] ..... E01B 33/00

[52] U.S. Cl. ..... 104/7.2

[58] Field of Search ..... 104/2, 7.1, 7.2, 104/8, 12

[56] References Cited

U.S. PATENT DOCUMENTS

| | | | |
|---|---|---|---|
| 4,046,078 | 9/1977 | Theurer | 104/7.2 |
| 4,046,079 | 9/1977 | Theurer | 104/7.2 |
| 4,064,807 | 12/1977 | Theurer | 104/7.3 |
| 4,094,251 | 6/1978 | Theurer | 104/12 |
| 4,430,946 | 2/1984 | Theurer et al. | 104/12 |
| 5,419,259 | 5/1995 | Theurer et al. | 104/7.2 |

OTHER PUBLICATIONS

Eisenbahntechnische Rundschau, Oct. 1987, pp. 663–667: G. Kaess "Erfahrungen und Ergebnisse . . . ".

*Primary Examiner*—S. Joseph Morano
*Attorney, Agent, or Firm*—Collard & Roe, P.C.

[57] ABSTRACT

A dynamic track stabilizer comprises a machine frame supported on the track by undercarriages for mobility along the track, and two track stabilization units linked to the machine frame by vertical adjustment drives, the track stabilization units being spaced from each other in the longitudinal direction and running on the track. Each track stabilization unit comprises a generator of oscillations connected to a drive for producing oscillations extending perpendicularly to the longitudinal direction, and the oscillation generators are arranged to produce oscillations which are displaced in phase.

4 Claims, 1 Drawing Sheet

TRACK STABILIZATION MACHINE HAVING STABILIZATION UNITS LINKED TO OSCILLATING OUT OF PHASE WITH EACH OTHER

BACKGROUND OF THE INVENTION

1. Field of the Invention

The present invention relates to a machine for stabilizing a track comprised of rails fastened to ties and extending in a longitudinal direction, which comprises a machine frame supported on the track by undercarriages for mobility along the track, and two track stabilization units linked to the machine frame by vertical adjustment drives, the track stabilization units being spaced from each other in the longitudinal direction and running on the track. Each track stabilization unit comprises a generator of oscillations connected to a drive for producing oscillations extending perpendicularly to the longitudinal direction.

2. Description of the Prior Art

The structure and operation of such a machine, commonly known as a dynamic track stabilizer, has been described in an article entitled "Erfahrungen und Ergebnisse aus dem Einsatz des dynamschien Gleisstabilsators" (Experiences and Results of the Use of the Dynamic Track Stabilizer), in the periodical "Eisenbahntechnische Rundschau" (Railroad Technical Review), October 1987, pp. 663–667. Two track stabilization units are mounted on a machine frame between the undercarriages on which the machine frame is supported for mobility on the track and a total of eight flanged wheels, and freely rotatable rollers gripping the rail heads at the field sides of the rails tightly hold the track rails connected to the track stabilization units. While the machine continuously advances along the track, the two synchronized oscillation generators impart horizontal, unidirectional oscillations to the track, which extend perpendicularly to the longitudinal direction of the track. The frequency of the oscillations varies from 0 to 45 Hz and, depending on the frequency, the force of impact varies from 0 to 350 kN.

At the same time, four hydraulic vertical adjustment drives, which link the track stabilization units to the machine frame, subject the track to a vertical load. The maximum vertical load is 360 kN. The horizontal oscillations and the simultaneous vertical load exerted by the track stabilization units causes the ballast in the cribs and under the ties to be compacted. This ballast compaction not only settles the track in the ballast but has the additional essential effect of increasing the friction between the ties and the greatly compacted ballast bed so that the resistance of the track to lateral displacement is maximized. A hydrostatic drive connected to the oscillation generators steplessly controls the generators to adapt the dynamic ballast compaction to the prevailing ballast bed conditions.

Numerous tests have shown that the vibrations caused by the oscillating track have no damaging impact on structures which are close to the track but they sometimes arouse anxiety or other negative feelings among passers-by and others who are not familiar with this track operation, particularly in densely populated areas.

By way of example, dynamic track stabilizers have been disclosed also in U.S. Pat. Nos. 4,046,078, 4,046,079 and 4,064,807.

SUMMARY OF THE INVENTION

It is the primary object of this invention to provide a dynamic track stabilizer in which the vibration emissions caused by the oscillations of the oscillation generators are limited to the regions immediately laterally adjacent the track shoulders.

The above and other objects are accomplished by the invention in a machine of the first-described type by arranging the oscillation generators so that they produce oscillations which are displaced in phase.

Surprisingly, the out-of-phase oscillations of the track stabilization units substantially reduce the vibration emissions without diminishing the ballast compaction to an extent worth mentioning. Therefore, the machine may be operated even in densely populated urban areas day and night without reducing its dynamic track stabilization effect. It is a particular advantage of the present invention that it requires only a minimal structural change, and the basic structure of the dynamic track stabilizer, which has been successfully used in track rehabilitation work for decades, need not be changed.

The extent of the phase displacement may be held constant by connecting the oscillation generators by a mechanical coupling.

According to another preferred embodiment, each oscillation generator comprises two eccentric elements rotating in opposite directions about a horizontal axis extending in the longitudinal direction for producing horizontal oscillations of sinuous form. This simple and dependable structure assures that both oscillations accurately extend in a common horizontal plane.

An optimal reduction of the vibrations emitted to the track environment is obtained if the oscillations are in phase opposition, being displaced by 180°.

BRIEF DESCRIPTION OF THE DRAWING

The above and other objects, advantages and features of this invention will become more apparent from the following detailed description of a now preferred embodiment thereof, taken in conjunction with the accompanying, somewhat diagrammatic drawing wherein.

DETAILED DESCRIPTION OF PREFERRED EMBODIMENT

Figure 1:
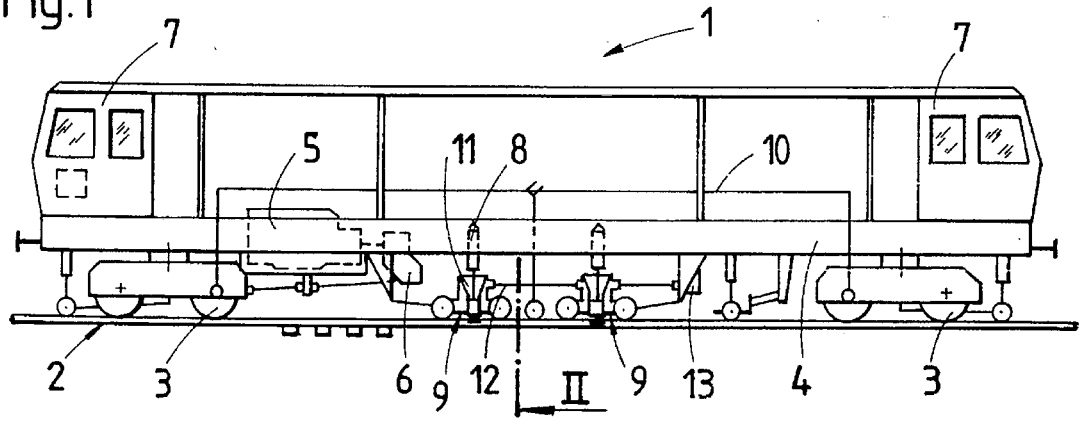
FIG. 1 is a side elevational view of a machine for stabilizing a track comprised of rails fastened to ties.

FIG. 1 shows machine 1 for stabilizing track 2 comprised of rails 17 (see FIG. 3) fastened to ties and extending in a longitudinal direction. Such a machine is commonly known as a dynamic track stabilizer and its general structure is entirely conventional. The machine comprises machine frame 4 supported on track 2 by undercarriages 3 for mobility along the track. It further comprises power plant 5, which provides energy to the operating drives of the machine, drive 6 for moving the machine along the track, and operator's cabs 7 at each end of machine frame 4. Two track stabilization units 9 are linked to machine frame 4 by vertical adjustment drives 8. The track stabilization units are positioned between undercarriages 3 below machine frame 4, and are spaced from each other in the longitudinal direction and run on the track. Reference system 10 controls the lowering of track 2.

Each track stabilization unit 9 comprises a generator 11 of oscillations connected to drive 13 for producing oscillations extending perpendicularly to the longitudinal direction in a horizontal plane, i.e. a plane extending parallel to the plane of the track. Mechanical coupling 12 in the form of a drive shaft connects the oscillation generators to each other to impart rotations to eccentric elements 15 of the generators.

Figure 2:
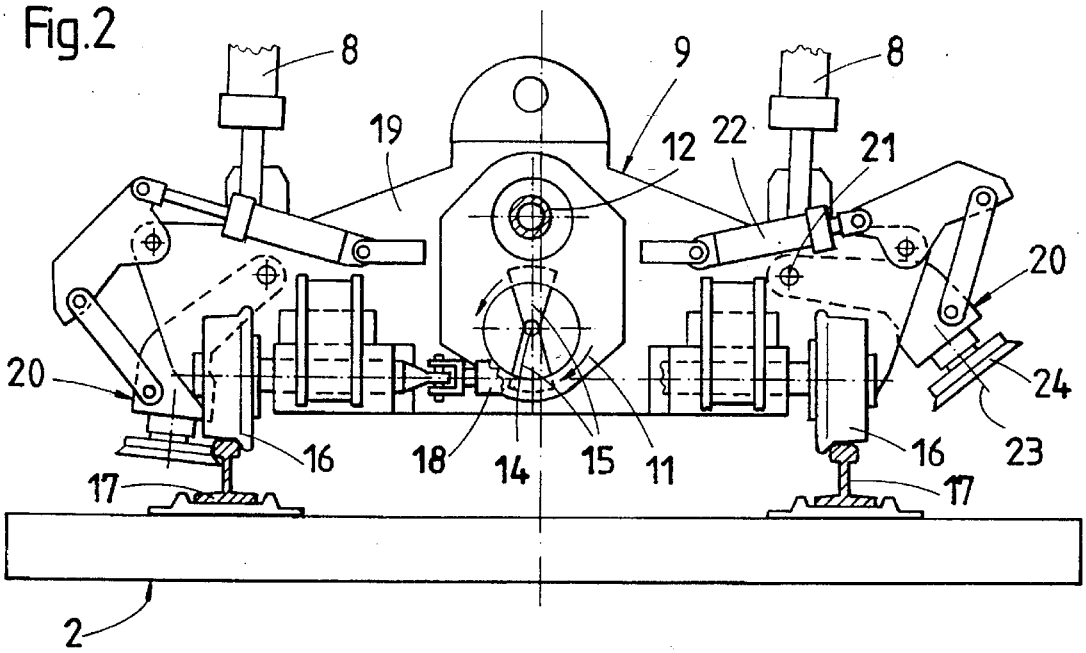
FIG. 2 is an enlarged sectional view of the machine, taken along line II of FIG. 1.

As shown in FIG. 2, each oscillation generator 11 comprises two eccentric elements 15 rotating at the same speed in opposite directions about horizontal axis 14 extending in the longitudinal direction for producing horizontal oscillations of sinuous form perpendicularly to the longitudinal direction. As shown, the oscillation generators are arranged to produce oscillations which are displaced in phase. In the illustrated embodiment, the oscillations are in phase opposition, being displaced by 180°, i.e. when one of the eccentric elements has reached its highest point in its rotary path, the other eccentric element is at its lowest point.

Each track stabilization unit 9 has a housing 19 linked to machine frame 4 by vertical adjustment drives 8 and four flanged wheels 16 running on rails 17 of track 2. Respective pairs of oppositely disposed flanged wheels 16 are connected by hydraulic spreading drive 18 which presses the flanges of the wheels against track rails 17 at the gage side thereof. A respective clamp 20 is mounted on each side of housing 19 for pivoting about axis 21 extending in the longitudinal direction. Each clamp is centered between two of the flanged wheels running on each rail 17 and comprises at its lower end a roller 24 freely rotatable about axis 23. Hydraulic drive 22 is linked to each clamp 20 to pivot roller 24 into engagement with associated rail 17 at the field side thereof, as shown on the left side of FIG. 2 (the right side of the figure showing the clamp pivoted into its inoperative position). In the operative position, spreading drive 18 presses flanged wheels 16 against rails 17 so that the rails are gripped tightly between the flanged wheels and rollers 24 and the oscillations produced by generators 11 are effectively transmitted to track 2.

Figure 3:
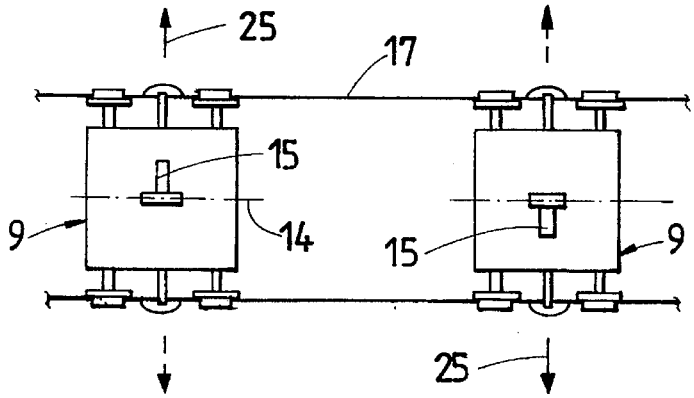
FIG. 3 is a schematic top view of the two track stabilization units.

The schematic illustration of FIG. 3 clearly shows that the phase displacement of the oscillations produced by the two track stabilization units 9 is 180°. Accordingly, the oscillation generator of one of the units 9 oscillates the track to the right, for example, while the other unit oscillates the track in the opposite direction to the left. These alternating oscillations are indicated by arrows 25 shown in full and phantom lines. The operation of the vertical load exerted upon track 2 by drives 8 is the same as in the conventional dynamic track stabilizers.

What is claimed is:

1. A machine for stabilizing a track comprised of rails fastened to ties and extending in a longitudinal direction, comprising (a) a machine frame supported on the track by undercarriages for mobility along the track, (b) two track stabilization units linked to the machine frame by vertical adjustment drives, the track stabilization units being spaced from each other in the longitudinal direction and running on the track, and each track stabilization unit comprising (1) a generator of oscillations connected to a drive for producing oscillations extending perpendicularly to the longitudinal direction, and (2) the oscillation generators being arranged to produce oscillations which are displaced in phase.

2. The machine of claim 1, further comprising a mechanical coupling connecting the oscillation generators.

3. The machine of claim 1, wherein each oscillation generator comprises two eccentric elements rotating in opposite directions about a horizontal axis extending in the longitudinal direction for producing horizontal oscillations of sinuous form.

4. The machine of claim 3, wherein the oscillations are in phase opposition, being displaced by 180°.

* * * * *